United States Patent [19]

Murakami et al.

[11] Patent Number: 4,495,048

[45] Date of Patent: Jan. 22, 1985

[54] APPARATUS FOR ELECTROLYSIS OF SALINE WATER

[75] Inventors: Katsuyuki Murakami, Maebashi; Kaoru Hirakata, Yoshiokamura; Shinichi Shimoda, Fujimimura; Reiichi Itai, Maebashi, all of Japan

[73] Assignee: The Japan Carlit Co., Ltd., Tokyo, Japan

[21] Appl. No.: 379,472

[22] Filed: May 18, 1982

[30] Foreign Application Priority Data

May 22, 1981 [JP] Japan ..... 56-77470

[51] Int. Cl.[3] ..... C25B 1/14; C25B 1/26

[52] U.S. Cl. ..... 204/267; 204/270; 204/268; 204/278; 204/274; 204/269

[58] Field of Search ..... 204/270, 269, 268, 239, 204/241, 274, 277, 278, 98

[56] References Cited

U.S. PATENT DOCUMENTS

| | | | |
|---|---|---|---|
| 2,925,371 | 2/1960 | Winckel et al. | 204/222 |
| 3,119,760 | 1/1964 | Foreman et al. | 204/269 |
| 3,657,099 | 4/1972 | Seko et al. | 204/253 |
| 3,849,281 | 11/1974 | Bennett et al. | 204/268 |
| 3,864,236 | 2/1975 | Lindstrom | 204/265 |
| 3,968,021 | 7/1976 | Rahn et al. | 204/256 |
| 4,107,023 | 8/1978 | Mentz | 204/269 |
| 4,151,052 | 4/1979 | Goto et al. | 204/95 |

FOREIGN PATENT DOCUMENTS

| | | | |
|---|---|---|---|
| 52-78675 | 7/1977 | Japan . | |
| 56-63378 | 4/1981 | Japan | 204/252 |

*Primary Examiner*—Brian E. Hearn
*Assistant Examiner*—Nathan Thane
*Attorney, Agent, or Firm*—Frishauf, Holtz, Goodman & Woodward

[57] ABSTRACT

A filter-press type electrolytic cell is disclosed wherein sodium hypochlorite is produced by diaphragmless electrolysis of saline water. The filter-press electrolytic cell is compact and simple in structure, and operates with improved current efficiency, at a reduced cell voltage, and with less power and with minimal maintenance.

6 Claims, 8 Drawing Figures

APPARATUS FOR ELECTROLYSIS OF SALINE WATER

BACKGROUND OF THE INVENTION

1. Field of the Invention

This invention relates to a filter-press type electrolytic cell wherein sodium hypochlorite is produced by diaphragmless electrolysis of saline water. Particularly, this invention relates to a saline water electrolytic cell which is effective to obtain saline water containing more than 10,000 ppm available chlorine with high current efficiency.

2. Description of Prior Art

Conventionally, chlorination has been used for the disinfection of water at waterworks and in sewage plants as well as in the oxidation of waste water. As a source of available chlorine, liquid chlorine or a sodium hypochlorite solution is used. However, these forms of available chlorine present some problems with respect to handling, economy and safety, so recently an electrochemical method wherein a sodium hypochlorite solution is generated by electrolysis of a dilute saline water like sea water has become popular.

To obtain a high concentration sodium hypochlorite solution by electrolyzing a dilute saline water, it is necessary to have a highly efficient method.

The inventors found that the use of the following anode in the saline water electrolytic cell increased current efficiency (approx. 80%) for production of sodium hypochlorite (10,000 ppm as available chlorine) and lowered cell voltage, thus reduced electric power consumption. Therefore, the advantages of the simple and compact structure coupled with a high current efficiency at a lowered cell voltage of the saline water electrolytic cell have been improved by the employment of an anode of a particular type as disclosed in Japanese Patent Publication No. 35473/1980. Such an anode comprises a substrate of titanium or an alloy thereof coated with a mixture consisting of a ternary mixture of platinum, palladium oxide, and ruthenium dioxide having a composition ranging from 3 to 42 wt % platinum, from 3 to 34 wt % palladium oxide, and from 42 to 94 wt % ruthenium dioxide on one hand, and from 20 to 40 wt % titanium dioxide based on the weight of said ternary mixture on the other hand.

In order to achieve further improved current efficiency for the production of sodium hypochlorite, a further study of the structure of the electrolytic cell is required.

In the conventional electrochemical methods for production of available chlorine, it is most economical to use a final available chlorine concentration of not more than 8,000 ppm, because as the concentrations of hypochlorite in electrolyte increases the current efficiency decreases as a result of increasing side reactions including an anodic oxidation and a cathodic reduction of hypochlorite ions. The current efficiency is further reduced either at too high or too low an electrolyte temperature. A temperature above 35° C., especially higher than 40° C., decreases the current efficiency about 10% or more, while a temperature below 15° C., especially below 10° C., lower the reaction rate of hydrolysis of chlorine to generate hypochlorite ions, reduces the current efficiency, and considerably shortens the life of an anode. Therefore, the temperature of the electrolyte must be kept within a range of from 15° to 35° C. However, the usual range of the dilute saline water supplied from a salt dissolving tank is from 2° to 30° C., and in summer the temperature of electrolyte may rise well over 50° C. So far, no device has been offered which is properly equipped to control the electrolyte temperature within the above-mentioned range of from 15° to 35° C. In a batchwise process, a cooler is provided in the recirculating tank, and in other processes an external cooler is often provided outside the electrolytic cell; in any case, it is inevitable that the whole system including piping becomes large and complex.

The volume of gas generated by the electrolysis, mainly hydrogen, grows along the course of the electrolyte stream, impeding its flow and in an extreme case making electrolysis impossible. It may also reduce current efficiency and increase the electrolyte resistivity, thus increasing cell voltages and electric power consumption. Therefore, it is most important to provide an apparatus that enables smooth separation of gas bubbles with a reduced volume of gas in electrolyte.

It is desirable to have an apparatus that is compact and simple in structure, requiring only a small floor area for installation, and that is easy to maintain. The circulation tank process wherein saline water is continuously supplied and a solution containing about 8,000 ppm available chlorine is generated by recirculating a predominant portion of the electrolyte and discharging a lesser portion of the electrolyte is not advantageous, since the electrolytic cell is always operated at a high available chlorine concentration. For this reason, either a batchwise process or a continuous process is usually employed. On account of the larger size required for the former process, the continuous process is preferred. In the continuous process, it is required to provide a sufficiently long electrolyte path to assure a sufficient retention time in order to have a high final hypochlorite concentration. Various means have been devised to incorporate a desirably long electrolyte path in a compact electrolytic cell. An electrolytic cell disclosed in Japanese Patent Publication No. 28104/1977 comprises a large number of electrolytic compartments stacked one upon another, each consisting of a pair made up of a horizontally disposed screen cathode and anode, through which a saline water flow is conducted from the bottom upwards in series. Such a structure is complicated, particularly in the formation of an electrolyte path and in the provision of electrode supports. Another electrolytic cell disclosed in Japanese Patent Public Disclosure No. 50476/1980 comprises forming an electrolyte path by inserting an anode assembly and a cathode assembly through each of two opposing side walls of a box-type cell. However, it may sometimes be impractical to obtain proper interlacing of each member electrode plate of the anode and cathode assemblies, particularly when the number of such member plates is very large. The electric connection to be provided on both sides of the cell may give another difficulty. In any case, it is necessary to provide a cooling means to cope with a rise in electrolyte temperature. With this type of structure, it is impossible to incorporate a cooling means in the electrolytic cell. An external cooling means would mean a large complex system consisting of an array of electrolyte and cooling water pipings.

The filter-press type electrolytic cell of the present invention is given as an apparatus wherein the various problems described above have been solved by alternately placing an electrode plate possessing drilled holes to provide saline water passage and a gasket cut out at the center to provide an electrolytic compartment and by repeating this arrangement until a desired number of such electrolytic compartments is obtained. This type has the advantage of having a compact and simple structure. An example of a similar configuration was disclosed in Japanese Patent Public Disclosure No. 78675/1977. In this example, however, the electrolyte flows up and down alternately, so that the proportion of electrolytic gas in electrolyte (mainly hydrogen) increases as the concentration of hypochlorite increases, thus considerably disturbing the flow of electrolyte and adversely affecting electrolysis. Also another example disclosed in Japanese Patent Publication No. 38431/1980 does not take into account any increase in the gas content of electrolyte with a limited final hypochlorite concentration achievable and a complicated cell configuration due to a very narrow choice of possible electrode shapes.

SUMMARY OF THE INVENTION

It is an object of this invention to provide a filter-press type electrolytic cell, wherein sodium hypochlorite is produced by diaphragmless electrolysis of saline water, said cell being compact and simple in structure and which operates with improved current efficiency, at a reduced cell voltage, and hence with less power and with minimal maintenance.

It is another object of this invention to provide a filter-press type electrolytic cell wherein it is easy to obtain saline water which contains more than 10,000 ppm available chlorine with a current efficiency of beyond 80%, or even about 90%.

Other objects and advantages of the present invention will become apparent to those skilled in the art from the following description and drawings.

DESCRIPTION OF THE PREFERRED EMBODIMENT

The characteristic features of the saline water electrolytic cell of the present invention in which an exclusive property of privilege is claimed are defined as follows:

(a) an end plate having holes for saline water pipe and through-bolts;

(b) an insulating piping plate provided with a saline water inlet piping in the lower part of a side;

(c) a terminal anode having a hole for saline water passage in the lower part of a side, a protruding upper edge serving as a terminal for bus connection, said anode consisting of a substrate of titanium or an alloy thereof and a coating applied on the surface of the anode coming into contact with the electrolyte, said coating comprising a ternary mixture of platinum - palladium oxide - ruthenium dioxide having a composition ranging from 3 to 42% by weight platinum, from 3 to 34% by weight palladium oxide, and from 42 to 94% by weight ruthenium dioxide, and titanium dioxide in a ratio ranging from 20 to 40% by weight based on said ternary mixture;

(d) an insulating frame gasket cut out at the center part;

(e) an intermediate bipolar electrode having two holes for saline water passage, one in the upper and another in the lower part on the same side, said electrode having the same coating on the anode surface as that of the terminal electrode;

(f) at least another set of said intermediate bipolar electrode and said insulating frame gasket to form at least another electrolytic compartment;

(g) a terminal cathode having two holes for saline water passage, one in the upper and another in the lower part on the same side, a protruding upper edge serving as a terminal for bus connection, said electrode being made of titanium or an alloy thereof;

(h) an insulating pipe plate provided with two saline water outlet pipes, one in the upper and another in the lower part of the same side;

(i) an end plate having two holes for two saline water pipes, one in the upper and another in the lower part on the same side and plural holes for through-bolts; wherein the ratio of the length to the width in the outer dimension of said insulating pipe plates, electrodes, and insulating frame gaskets is in the range of 1 : 1.1–10 as one of the essential conditions of this invention, and when a plurarity of electrolytic compartments are used, the electrolytic cell also comprises one or more heat exchanging frames or gasket and/or degassing blocks inserted after every 3 to 7 compartments.

Figure 1:
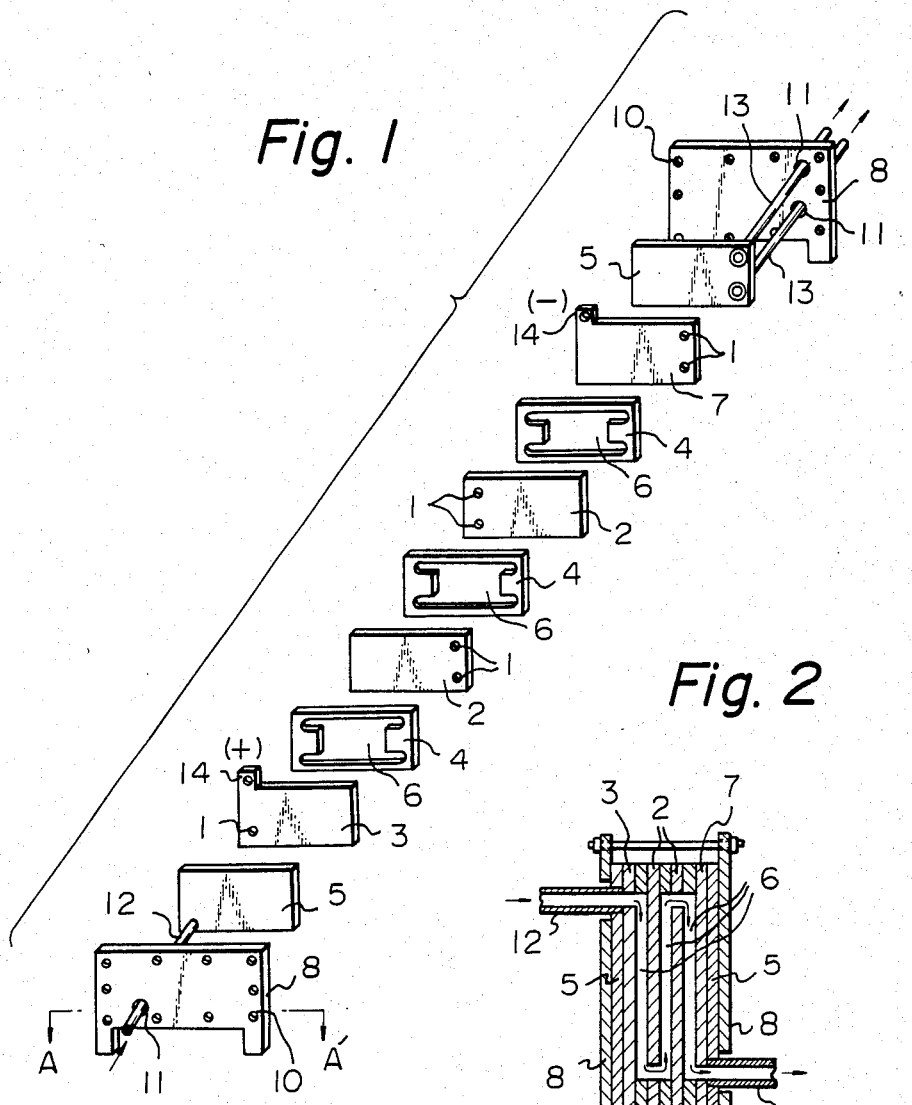
FIG. 1 is an exploded isometric view of a saline water electrolytic cell of this invention.
Figure 2:
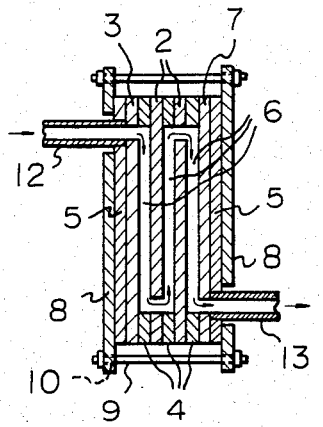
FIG. 2 is a schematic cross-sectional view along line A—A' in FIG. 1.

One embodiment of the saline water electrolytic cell of this invention is described in reference to the accompanying drawings shown in FIGS. 1–8. As shown in FIGS. 1 and 2, a three-compartment electrolytic cell 6 is formed by placing between an insulating pipe plate 5 having a saline water inlet pipe 12 in the lower part on a side and another insulating pipe plate 5 having two saline water outlet pipes 13, one in the upper and another in the lower part on the same side, a partial assembly formed by alternately stacking together two intermediate bipolar electrodes 2 having two holes for saline water passage 1, one in the upper and another in the lower part on the same side, a terminal anode 3 having a hole for saline water passage 1 in the lower part on a side and a terminal 14, a terminal cathode 7 having two holes for saline water passage 1, one in the upper and another in the lower part on the same side and a terminal 14, and three insulating frame gaskets 4 cut out in the center part, and with the aid of an end plate 8 having holes for through-bolts 10 and a hole for a saline water pipe 11 in the lower part on a side and another end plate 8 having two holes for saline water pipes 11, one in the upper and another in the lower part of the same side and holes for through-bolts 10, both end plates 8 being placed on the opposite sides of said assembly, by tightening the whole thing with through-bolts 9 into a single assembly. Approximately 3% by weight saline water supplied from the saline water inlet pipe 12 is electrolyzed while horizontally snaking through each electrolytic compartment 6 whereby an electrolyte with little gas entrained flows through the lower hole for saline water passage 1, while an electrolyte containing more electrolytic gas separated as it rises through the electrolyte flows through the upper hole for saline water passage 1, and an electrolyte containing sodium hypochlorite is discharged from the saline water outlet pipe 13.

Figures 3, 4:
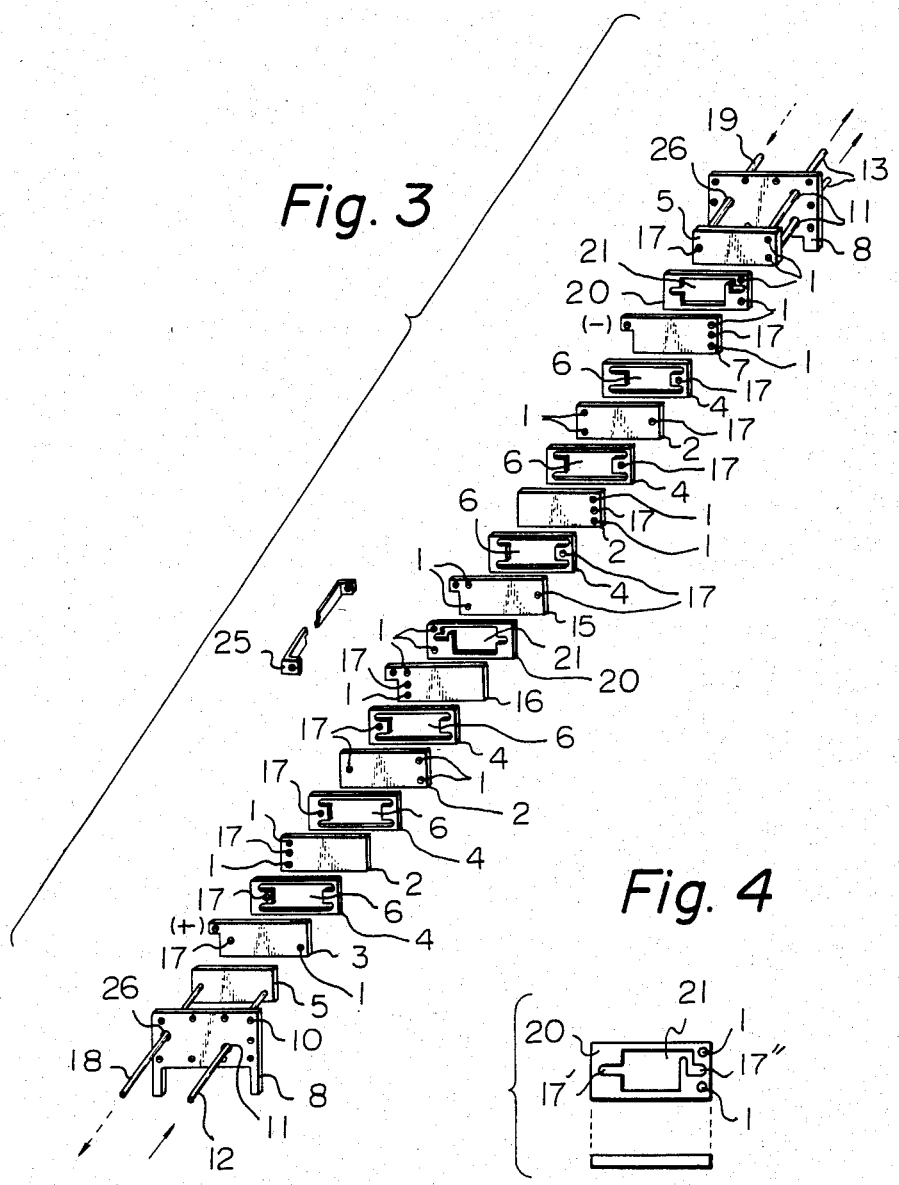
FIG. 3 is an exploded isometric view of a saline water electrolytic cell provided with heat exchanging gaskets.
FIG. 4 is a plan and elevation view of a heat exchanging gasket.

FIG. 3 is a schematic diagram showing an example of another saline water electrolytic cell of this invention provided with a heat exchanging means. Two heat exchanging compartments 21 are formed by inserting a heat exchanging gasket 20 between an insulating pipe plate 5 having two saline water outlet pipes 13, one in the upper and another in the lower part of the same side and a coolant inlet pipe 19 on the other side and a terminal cathode 7, and by inserting another heat exchanging gasket 20 between an intermediate terminal anode 15 and an intermediate terminal cathode 16. Partial assemblies are formed in a similar manner as in the preceding example shown in FIG. 2 except that each member has an additional hole for coolant passage. Said electrolytic cell is now formed by tightening together with through-bolts 9, an end plate 8 having a hole 11 for a salt water inlet pipe 12 and another hole 26 for a coolant outlet pipe 18, an insulating pipe plate 5 having a salt water inlet pipe 12 and a coolant outlet pipe 18, one of the partial assemblies, a heat exchanging compartment 21 of the second type described above, another partial assembly, a heat exchanging compartment 21 of the first type described above, an insulating pipe plate 5 having two salt water outlet pipes 13, one in the upper and another in the lower part on the same side and a coolant inlet pipe 19 on the other side, and an end plate 8 having hole 11 for the two salt water outlet pipes 13 and a hole 26 for the coolant inlet pipe 19, in this order. An intermediate terminal cathode 16 and an intermediate terminal anode 15 are connected with a bus 25. The flow of dilute saline water is similar to the examples given in FIGS. 1 and 2. The heat exchanging water (cooling water) enters the electrolytic cell via the coolant inlet pipe 19 and leaves at the coolant outlet pipe 18 in order to realize a counter-current contact of the cooling water with the electrolyte, firstly through a terminal cathode 7 and secondly through an intermediate terminal cathode 16. An increased cooling area can be obtained by simply inserting a heat exchanging plate made of a corrosion resistant metal such as titanium (not shown in FIG. 3). In the wintertime when the electrolyte temperature becomes too low, the effluent coolant warmed through the heat exchange function while flowing through the electrolytic cell may be used as the diluting water to make up a dilute saline water out of a saturated brine fed from a salt dissolving tank, thus eliminating any possible danger of lowered current efficiency and shortened electrode life due to any excessively low electrolyte temperature which may be present with the first through third electrolytic compartments of the electrolytic cell. In the summertime, on the other hand, when a larger amount of cooling water is required, any excess warmed effluent coolant can be disposed of.

FIG. 4 is a schematic diagram showing an example of a heat exchanging gasket 20 to be used in a saline water electrolytic cell of this invention. In this case, the heat exchanging water that has entered the cell via the inlet pipe 19 is discharged via the coolant passage 17 into an inlet of heat exchanging water inlet 17' of the heat exchanging gasket 20, takes a horizontal path within a heat exchanging compartment 21 wherein heat exchange function takes place on the surface of the terminal cathode 7 passing through a heat exchanging compartment 21, and is conducted through a coolant outlet 17'' into a hole for heat exchanging water passage 17 of a terminal cathode 7. While the heat exchanging water cools down the electrolyte on the other side of the terminal cathode 7, the coolant itself is warmed. One heat exchanging gasket 20 is usually inserted every 3 to 7 electrolytic compartments. To insert every two compartments or less may require an increased number of intermediate terminal cathodes and anodes compared to the number of electrolytic compartments, thus making the electric connection excessively complex. On the other hand, if inserted every 8 compartments or more insufficient cooling may result. In order to realize an increased heat exchanging area, a heat exchanging plate (not shown) of a corrosion resistant metal such as titanium having a hole for heat exchanging water passage on a side and two holes for saline water passage, one in the upper and another in the lower part on the other side is used, both surfaces of which serve as heat exchanging surfaces. Such a heat exchanging plate is used with a heat exchanging gasket on one surface side and a degassing gasket (not shown) having two holes for saline water passage, one in the upper and another in the lower part on the same side, a hole for heat exchanging water passage and a degassing pipe 23 on the other surface side.

Figure 5:
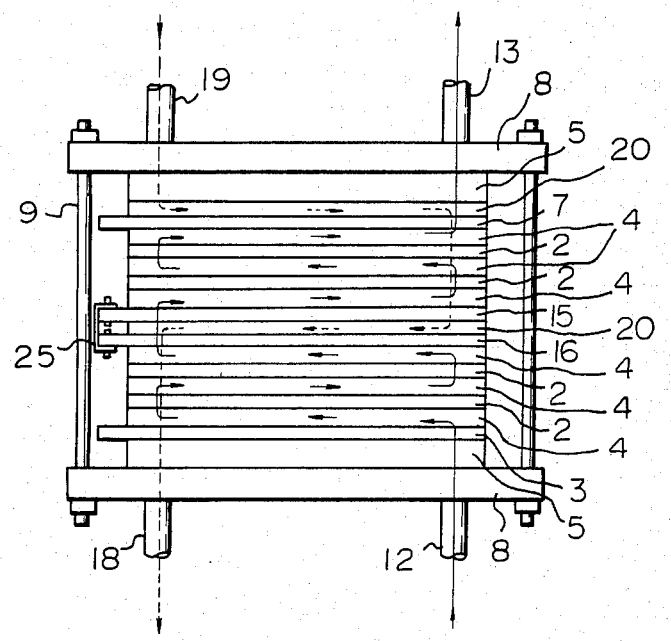
FIG. 5 is a schematic plane view showing the flow of saline water and heat exchanging water.

FIG. 5 is a plane view visualizing the flow of saline water and that of heat exchanging water whereby the flow of heat exchanging water is shown by dotted line arrows and that of the electrolyte by solid line arrows. The dilute saline water supplied to a saline water passage inlet pipe 12 may be prepared by the warmed water discharged from a heat exchanging water passage outlet pipe 18 as diluting water.

Figure 6:
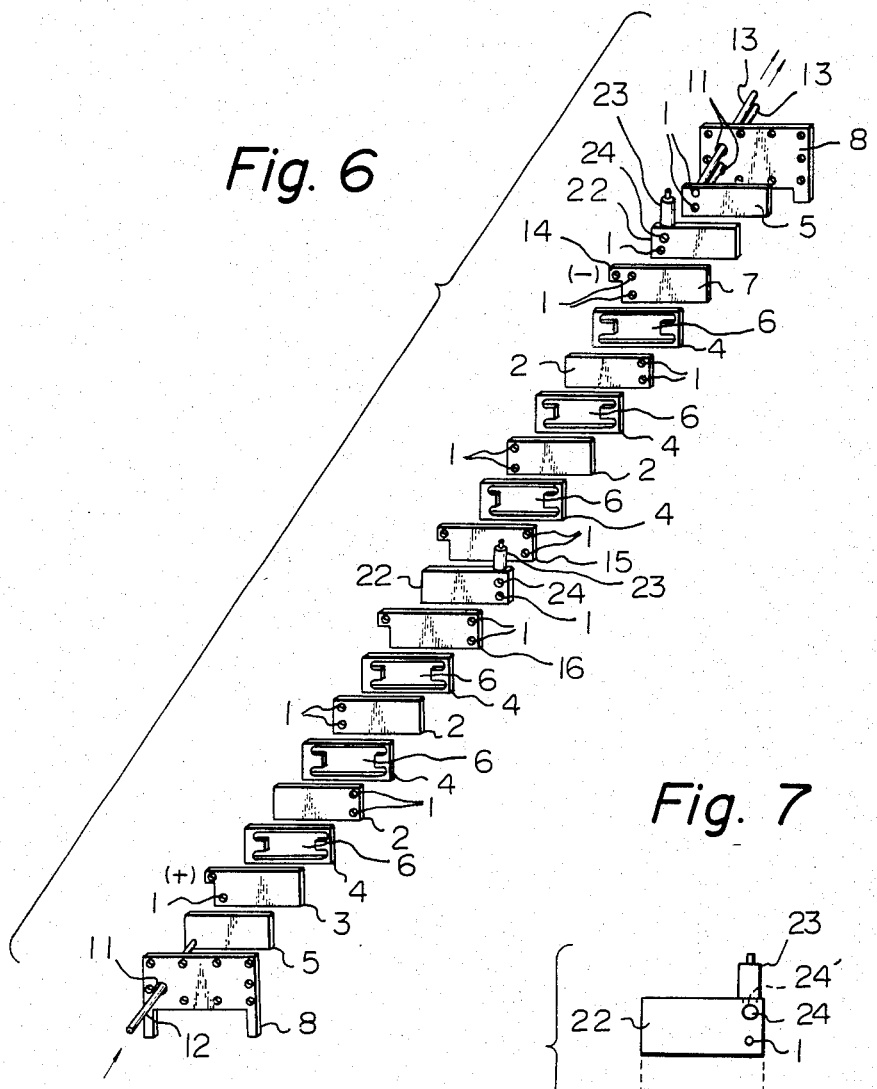
FIG. 6 is an exploded isometric view of a said cell provided with degassing blocks.

FIG. 6 is a schematic diagram showing an example of a saline water electrolytic cell of this invention provided with a degassing means in which two degassing blocks 22 having a degassing pipe 23 are inserted, one between an intermediate terminal anode 15 and an intermediate terminal cathode 16 and another between an insulating pipe plate 5 having two saline water passage outlet pipes 13 one in the upper and another in the lower part on a side and a terminal cathode 7, whereby the flow of dilute saline water is similar to FIGS. 1, 2 and 3.

The gas (mainly hydrogen) generated by electrolysis forms a thick frothy layer in the upper part of each electrolytic compartment, passes through each hole for saline water passage 1 thereof, and is finally discharged through a degassing pipe 23 after passing through the hole for gas passage 24 of said degassing block 22. The degassing pipe 23 serves as a vapor-liquid separator to prevent any electrolyte from being entrained by an out going gas exhaust. The degassing block is usually inserted every 3–7 electrolytic compartments. If inserted in every other compartment or less, the electric connections to be provided for the cell may become complex as in the case of the heat exchanging gasket; on the other hand, to insert one every 8 compartments or more may not be desirable because the proportion of electrolytic gas in the electrolyte exceeds 70% by volume. The degassing block prevents such difficulties as increasing pressure drops and the rise of cell voltage due to the increasing proportion of gas in the electrolyte. As mentioned above, when a heat exchanging plate is employed, a degassing gasket is used instead of a degassing block.

Figure 7:
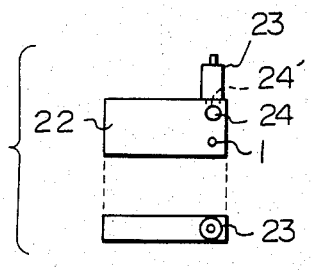
FIG. 7 is a front and plane view of a degassing block.

FIG. 7 is a schematic diagram showing an example of a degassing block 22. When an electrolyte containing a high proportion of electrolytic gas passes through a hole for gas passage 24 of the degassing block 22, the electrolytic gas rises through a hole for gas lift 24' and is separated from liquid within the degassing pipe 23. In order to assure easy separation of gas bubbles, the internal diameter of the hole for gas passage 24 should be larger than that of the hole for saline water passage 1.

Figure 8:
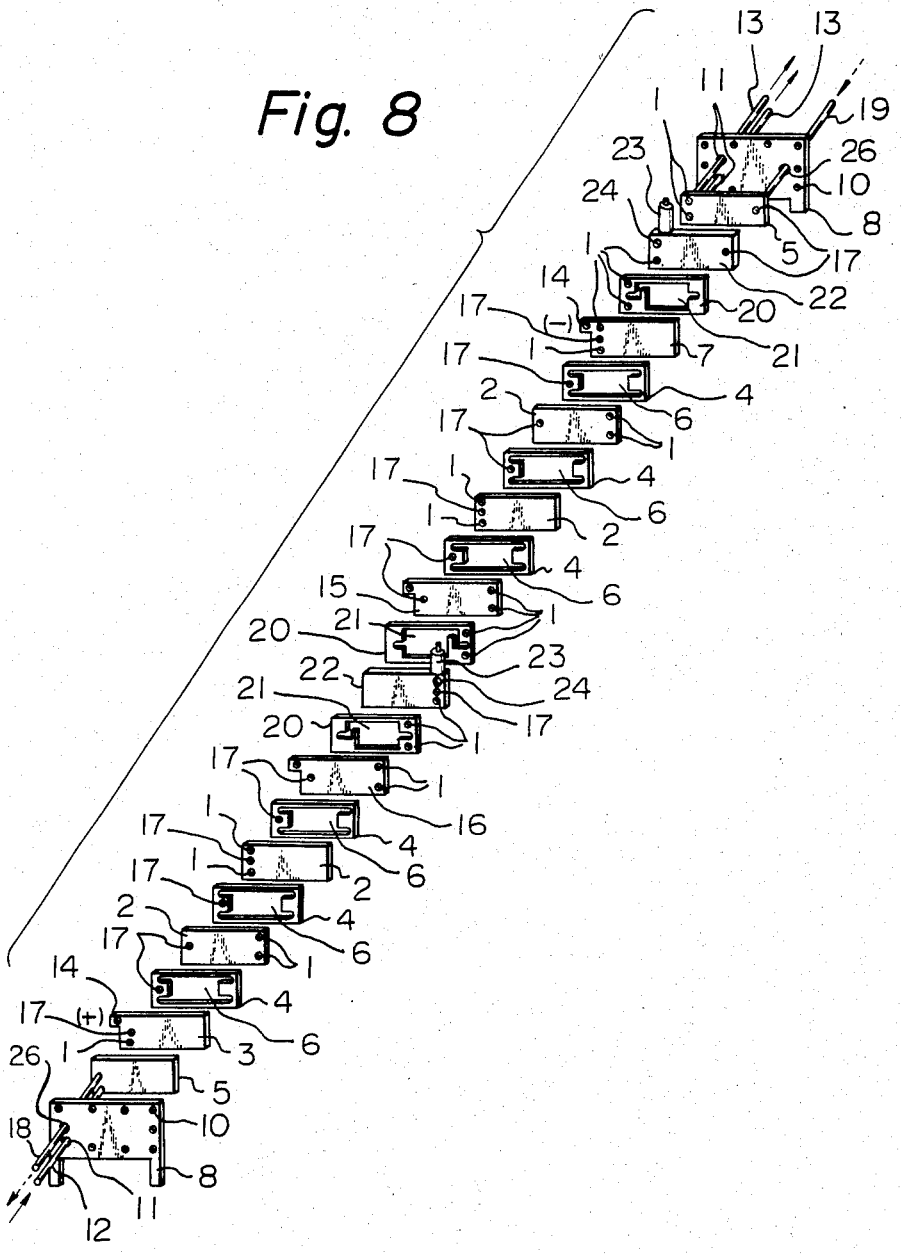
FIG. 8 is an exploded isometric view of a saline water electrolytic cell provided with heat exchanging gaskets and degassing blocks.

FIG. 8 is a schematic diagram showing an example of a saline water electrolytic cell of this invention provided with both heat exchanging means and degassing means, in which three heat exchanging gaskets 20 coupled with two degassing blocks 22 are inserted, a first heat exchanging gasket 20 between an intermediate terminal cathode 16 and a first degassing block 22, a second heat exchanging gasket 20 between said degassing block 22 and an intermediate terminal anode 15 and a third heat exchanging gasket 20 between a terminal cathode 7 and a second degassing block 22. The flow of saline water and of heat exchanging water, and the exhaust flow of electrolytic gas are similar to those described above. In this way, a combination of heat exchanging and degassing means prevents any excessive rise or fall of the electrolyte temperature, while maintaining a smooth flow of electrolyte through degassing.

An anode of the type described above can be prepared as follows. After degassing the surface of a substrate made of titanium or an alloy thereof, it is treated with hydrofluoric acid and oxalic acid, onto which is applied by painting or dipping into a mixed solution prepared by adding to so much of platinum tetrachloride, palladium dichloride, and ruthenium trichloride as to maintain a ratio of platinum : palladium oxide : ruthenium dioxide within the range specified by this invention, a small amount of hydrochloric acid, so much of n-butyl alcohol as to dissolve said mixture completely, and finally a prescribed amount of butyl-titanate. After drying, it is heated for 10–30 minutes in air at a temperature in the range of from 450° to 600° C. A coating of an expected thickness is obtained by repeating the application-heat treatment cycle.

The preferred interelectrode distance of the saline water electrolytic cell of this invention is 2–6 mm. When a heat exchanging gasket and/or a degassing block is inserted between adjacent electrolytic compartments, an intermediate terminal cathode and an intermediate terminal anode are used, said intermediate terminal cathode and said intermediate terminal anode being connected with a bus 25. Every electrode is longer in the horizontal than the vertical dimension, the ratio of the length to the width thereof preferably being within the range of 1 : 1.1–10.

Therefore, the saline water electrolytic cell of this invention is also of a horizontal type. A vertical type cell would cause an upwardly increasing gas fraction of electrolyte on the surface of the electrode and slows down the electrolyte flow upwards, thus increasing the gas hold up, resistivity of electrolyte, and the rate of scaling on the cathode surface which require intensified cleaning of the cell. On the contrary, a horizontal type cell accelerates the flow of electrolyte, reducing the scaling on the cathode to facilitate maintenance, and allowing smooth separation of electrolytic gas. With an excessively long horizontal dimension, however, the effect of vapor-liquid separation will decrease, and a larger floor area for installation will be required which is uneconomical.

The saline water electrolytic cell of this invention is formed of 4–50 compartments; with less than 4 compartments, the relative cost of investment will be excessively high while with more than 50 compartments the terminal voltage may become dangerously high. Usually, 6–40 compartments are suitable. The heat exchanging gasket is inserted every 3–7 compartments depending on the seasonal changes in the electrolyte temperature. The degassing block also is inserted every 3–7 compartments depending on the gas content of the electrolyte which should be kept below 70% by volume.

The saline water electrolytic cell of this invention may also be used for electrolysis of sea water. In this case, the relatively high flow rate of the sea water feed eliminates such problems as the rise in temperature and the increase in the gas content of sea water so that an electrolytic cell of this invention can be formed only with the end plates, insulating pipe plates, electrodes and insulating gaskets but without any heat exchanging gasket or any degassing block, thereby permitting the use of a platinum coated anode.

As the saline water electrolytic cell of this invention is made of plastics like polyvinyl chloride except for the steel end plates which does not come into contact with the electrolyte and electrodes with a substrate of titanium or an alloy thereof, it is substantially corrosion-resistant, a feature highly advantageous with respect to maintenance.

The saline water electrolytic cell of this invention is provided with a heat exchanging means in an electrolytic compartment, wherein any rise of the electrolyte temperature can be prevented by counter-current contact of the electrolyte with cooling water, while utilizing the warmed coolant for diluting the saline water to be supplied to the electrolytic cell, thus further eliminating difficulties of deteriorating electrode activity and hence decreasing current efficiency due to low electrolyte temperatures. The horizontal configuration of the electrolytic compartment also enables undisturbed separation of electrolytic gas by installing suitable degassing means, which results in reduced gas holdup within the electrolyte, preventing any loss of the current efficiency or any rise of the cell voltage. In this way, therefore, it is easy to obtain saline water which contains more than 10,000 ppm available chlorine with a current efficiency of beyond 80%, or even about 90% which has conventionally been very difficult to attain. Also the adoption of a filter-press type configuration with a built-in heat exchanging means and a degassing means results in a compact and simplified structure with such additional advantages as ease of maintenance caused by less cathode scaling, and highly corrosion-resistant materials used and lower labor cost for fabrication because little if any welding work is involved. The various advantages described above make the saline water electrolytic cell of this invention of remarkably high practical value.

The following examples are given to further illustrate this invention but it should be understood that the invention is by no means limited thereto. On the contrary, they are given only to clarify some of the essential embodiments of the present invention.

EXAMPLE 1

As shown in FIG. 8, a saline water electrolytic cell having a capacity of 400 g/h available chlorine was formed by placing between the insulating pipe plate and the end plate three heat exchanging compartments, two degassing blocks and two three-compartment assemblies consisting of six insulating gaskets made of soft polyvinyl chloride sheet, a coated terminal anode, a coated intermediate terminal anode, four coated intermediate bipolar electrodes, an uncoated intermediate terminal cathode, and an uncoated terminal cathode, said coated anode comprising a titanium plate 2 mm thick coated with a mixture consisting of a ternary mixture containing 25% by weight platinum, 20% by weight palladium oxide, and 55% by weight ruthenium dioxide and 30% by weight titanium dioxide based on said ternary mixture.

The assembled cell had outer dimension of 660 mm (width)×200 mm (depth)×230 mm (height). Cooling water at a temperature of 15° C. (a dotted line arrow) was fed through a heat exchanging water passage inlet pipe, the total amount of the effluent cooling water being discharged at the heat exchanging water passage outlet pipe at a temperature of 24° C. was used for diluting saturated brine. A 3% by weight dilute saline water thus obtained was supplied to the saline water electrolytic cell (a solid line arrow) through a saline water passage inlet pipe at a flow rate of 40 l/h.

As a result of continuous electrolysis with DC 60 A at about 27 V, a dilute saline water having a temperature of 28° C. containing 10,500–11,100 ppm available chlorine in the form of sodium hypochlorite was obtained. The electrolytic gas was exhausted through two degassing pipes after vapor-liquid separation, thereby causing no obstruction to flow and no rise in cell voltage. A steady-state current efficiency of 91%, a power consumption of 3.7 kWh per 1 kg of available chlorine and a utilization for salt of about 30% were obtained.

This system was successfully run continuously well over a period of about 3 months before acid cleaning was practised.

EXAMPLES 2–3

A saline water electrolytic cell similar to that of Example 1, except for a varied capacity for available chlorine generation, that is, a varied number of electrolytic compartments, a varied number of heat exchanging compartments, a varied electrolytic current and/or a varied flow rate of dilute saline water supply was operated. The specifications for the electrolytic cell employed and the results obtained are shown in Table 1.

Example 2 shows a run in the summertime wereby about 50–60% of cooling water supplied to the heat exchanging compartments was required to be used as diluting water with a 40–50% surplus.

Example 3 shows a wintertime operation.

TABLE 1

| | Electrolytic cell | | | | | | | |
|---|---|---|---|---|---|---|---|---|
| | Generation rate of available chlorine | Electrolytic compartments | | Number of heat exchanging compartments | Number of degassing blocks | DC | | Flow of 3% saline water |
| Ex. | (g/h) | Number of compartments | Number of sets | | | Current (A) | Voltage (V) | (l/h) |
| 2 | 2500 | 30 | 5 | 9 | 5 | 75 | about 130 | 250 |
| 3 | 240 | 15 | 3 | 5 | 3 | 15 | about 68 | 20 |

| | | Electrolyte temperature (°C.) | | | | | | | |
|---|---|---|---|---|---|---|---|---|---|
| | Conc. of available chlorine | Heat exchanging compartment | | Electrolytic compartment | | Current efficiency | Power consumption (kWh/ | Utilization of salt | Frequency of acid cleaning |
| Ex. | (ppm) | Inlet | Outlet | Inlet | Outlet | (%) | kg-$Cl_2$) | (%) | (times/year) |
| 2 | 10,200~10,600 | 25 | 30 | 30 | 33 | 88 | 3.7 | about 29 | about 4 |
| 3 | 12,100~12,600 | 5 | 17 | 17 | 22 | 83 | 4.1 | about 34 | about 4 |

EXAMPLE 4

As shown in FIG. 1, a twenty-compartment electrolytic cell having a capacity of 2.5 kg/h available chlorine was formed by tightening with two insulating pipe plates and two end plates on both ends an assembly made by alternately stacking together a coated terminal anode, nineteen coated intermediate bipolar electrodes, an uncoated terminal cathode comprising a 2-mm thick titanium plate, and twenty soft polyvinyl chloride framed gaskets, said coated anode and said coated intermediate bipolar electrodes having a platinum layer laid on a 2-mm thick titanium plate. The assembled cell had outer dimension of 650 mm (width)×270 mm (depth)×450 mm (height).

Sea water was supplied to the electrolytic cell at a flow rate of 60 l/min through the saline water passage inlet pipe, and as the result of continuous electrolysis with DC 125 A at 110 V fed from a rectifier, sea water containing 700–740 ppm available chlorine was continuously obtained, at a steady-state current efficiency of 78% and a power consumption of about 5.3 kWh/kg-$Cl_2$. The rise in temperature of sea water was found to be about 1° C., causing no trouble, and the cell was operated successfully without any noticeable flow or disturbance or rise in cell voltage due to gas generation.

EXAMPLE 5

The specifications for a typical commercial saline water electrolytic cell and a saline water electrolytic cell of this invention are compared in Table 2.

TABLE 2

| | Commercial cell | Cell of this invention |
|---|---|---|
| Available chlorine concentration (ppm) | about 8,000 | more than 10,000 |
| NaCl concentration in feed (% by weight) | 3 | 3 |
| Salt consumption (kg/kg-$Cl_2$) | 3.5 | 3 |
| Electrolytic temperature | 5–50[a] | 15–35 |

TABLE 2-continued

| | Commercial cell | Cell of this invention |
|---|---|---|
| (°C.) | | |
| Power consumption (kWh/Kg-$Cl_2$) | 5.5–8 | 4.3–5.5 |
| Current efficiency (%) | 50–80 | 80–92 |
| Outer dimension of cell (mm) (width × thickness × height)[b] | 400 × 500 × 600 | 500 × 500 × 300 |
| Interval of acid cleaning (h) | every about 1,500 | every 1,500–3,000 |

[a]without any cooling means
[b]at a generation rate of 2 kg/h available chlorine producted

What is claimed is:

1. A filter-press type electrolytic cell, wherein sodium hypochlorite is produced by diaphragmless electrolysis of saline water, comprising:

first and second end plates vertically disposed in spaced parallel relationship;

a plurality of planar electrodes successively separated from each other and from the end plates;

planar insulating members vertically disposed in parallel relationship to each other and interposed between said planar electrodes and between said planar electrodes and said end plates to successively separate said planar electrodes from each other and to separate said planar electrodes from said end plates, thereby forming a plurality of electrolytic compartments between successive electrodes;

said first end plate having a hole in the lower part thereof on a side for receiving an electrolyte inlet pipe, and a plurality of holes located peripherally along the marginal edges for receiving bolts therethrough;

one of said insulating members being adjacent said first end plate, said one of said insulating members being a first insulating pipe plate having a hole in the lower part on one side thereof for receiving said electrolyte inlet pipe, said electrolyte inlet pipe passing through said first end plate and disposed substantially perpendicularly to said first insulating pipe plate;

one of said planar electrodes being adjacent said first insulating pipe plate, said one of said planar electrodes being a terminal anode having a hole in a lower part on a side for receiving electrolyte from the electrolyte inlet pipe, said terminal anode having a protruding upper edge serving as an electrical connection terminal, said terminal anode consisting essentially of a substrate of titanium or an alloy thereof and a coating applied on the surface of the terminal anode coming in contact with the electrolyte, said coating comprising a ternary mixture of platinum-palladium oxide-ruthenium dioxide having a composition ranging from 3 to 42% by weight of platinum, from 3 to 4% by weight of palladium oxide and from 42 to 94% by weight of ruthenium dioxide, and titanium dioxide in a ratio ranging from 20 to 40% by weight based on the weight of said ternary mixture;

the second end plate having a pair of holes, one of said holes being in an upper part of one side of said second end plate and the other of said holes being in a lower part of the same side of said second end plate, each of said pair of holes receiving an electrolyte outlet pipe, said second end plate also having a plurality of holes peripherally along the marginal edges for receiving bolts therethrough;

another of said insulating members being adjacent said second end plate, said another of said insulating members being a second insulating pipe plate having a pair of holes for receiving said electrolyte outlet pipes, one of said pair of holes being in an upper part of one side of said another of said insulating members and the other of said pair of holes being in a lower part on the same side of said another insulating member, said electrolyte outlet pipes passing through said pair of holes in said second end plate and being disposed substantially perpendicularly to said second insulating pipe plate;

another of said planar electrodes being adjacent said second insulating pipe plate, said another of said planar electrodes being a terminal cathode having a pair of holes for passing electrolyte to the electrolyte outlet pipes, one of said pair of holes being in an upper part of one side of said terminal cathode and another of said pair of holes being in a lower part on the same side of said terminal cathode, said terminal cathode having a protruding upper edge serving as an electrical connection terminal, said terminal cathode consisting essentially of titanium or an alloy of titanium;

said planar insulating members including at least one intermediate insulating member comprising an insulating frame gasket cut out at a central portion to form at least one hollow electrolytic compartment between successive electrodes;

said plurality of planar electrodes including at least one intermediate electrode comprising a bipolar electrode having a pair of holes for passing electrolyte therethrough, one of said pair of holes being in an upper part of one side of said intermediate electrode and the other of said pair of holes being in a lower part on the same side of said intermediate electrode; said intermediate electrode having the same coating on its anode surface as that of the terminal anode;

the holes for passing electrolyte in said planar electrodes being disposed on opposite sides of successive electrodes to provide a sinuous flow path for the electrolyte through said at least one electrolytic compartment;

the ratio of the length to the width of the outer dimension of said planar electrodes and said planar insulating members being within the range of from 1:1.1 to 1:10;

said insulating members and electrodes defining at least three hollow electrolytic compartments;

a planar degassing block inserted after every group of 3 to 7 of said electrolytic compartments, said degassing block comprising a pair of holes, one of said pair of holes being in an upper part of a side of said planar degassing block for passing gas and another of said pair of holes being in a lower part of the same side of said degassing block for passing electrolyte;

a degassing pipe communicating with said gas passing hole for passing gas; and an intermediate terminal anode and an intermediate terminal cathode being on opposed faces of said planar degassing block, each of said intermediate terminal anode and said terminal cathode having a pair of holes for passing electrolyte, one of said pair of holes being in an upper part of said intermediate terminal anode and said intermediate terminal cathode on the same side and another of said holes being in the lower part on the same side thereof; and a protruding upper edge serving as an electrical connection terminal on the other side of said intermediate terminal anode and said intermediate terminal cathode;

and wherein the ratio of the length to the width of the outer dimension of said planar degassing block, said intermediate terminal anode and said intermediate terminal cathode is within the range of from 1:1.1 to 1:10.

2. The filter-press type electrolytic cell of claim 1 wherein said planar degassing block is positioned between said second end plate and said second insulating pipe plate, said degassing pipe being on the upper edge of said planar degassing block.

3. A filter-press type electrolytic cell, wherein sodium hypochlorite is produced by diaphragmless electrolysis of saline water, comprising:

first and second end plates vertically disposed in spaced parallel relationship;

a plurality of planar electrodes successively separated from each other and from the end plates;

planar insulating members vertically disposed in parallel relationship to each other and interposed between said planar electrodes and between said planar electrodes and said end plates to successively separate said planar electrodes from each other and to separate said planar electrodes from said end plates, thereby forming a plurality of electrolytic compartments between successive electrodes;

said first end plate having a hole in the lower part thereof on a side for receiving an electrolyte inlet pipe, and a plurality of holes located peripherally along the marginal edges for receiving bolts therethrough;

one of said insulating members being adjacent said first end plate, said one of said insulating members being a first insulating pipe plate having a hole in the lower part on one side thereof for receiving said electrolyte inlet pipe, said electrolyte inlet pipe passing through said first end plate and disposed substantially perpendicularly to said first insulating pipe plate;

one of said planar electrodes being adjacent said first insulating pipe plate, said one of said planar electrodes being a terminal anode having a hole in a lower part on a side for receiving electrolyte from the electrolyte inlet pipe, said terminal anode having a protruding upper edge serving as an electrical connection terminal, said terminal anode consisting essentially of a substrate of titanium or an alloy thereof and a coating applied on the surface of the terminal anode coming in contact with the electrolyte, said coating comprising a ternary mixture of platinum-palladium oxide-ruthenium dioxide having a composition ranging from 3 to 42% by weight of platinum, from 3 to 34% by weight of palladium oxide and from 42% by weight of ruthenium dioxide, and titanium dioxide in a ratio ranging from 20 to 40% by weight based on the weight of said ternary mixture;

the second end plate having a pair of holes, one of said holes being in an upper part of one side of said second end plate and the other of said holes being in a lower part of the same side of said second end plate, each of said pair of holes receiving an electrolyte outlet pipe, said second end plate also having a plurality of holes peripherally along the marginal edges for receiving bolts therethrough;

another of said insulating members being adjacent said second end plate, said another of said insulating members being a second insulating pipe plate having a pair of holes for receiving said electrolyte outlet pipes, one of said pair of holes being in an upper part of one side of said another of said insulating members and the other of said pair of holes being in a lower part on the same side of said another insulating member, said electrolyte outlet pipes passing through said pair of holes in said second end plate and being disposed substantially perpendicularly to said second insulating pipe plate;

another of said planar electrodes being adjacent said second insulating pipe plate, said another of said planar electrodes being a terminal cathode having a pair of holes for passing electrolyte to the electrolyte outlet pipes, one of said pair of holes being in an upper part of one side of said terminal cathode and another of said pair of holes being in a lower part on the same side of said terminal cathode, said terminal cathode having a protruding upper edge serving as an electrical connection terminal, said terminal cathode consisting essentially of titanium or an alloy of titanium;

said planar insulating members including at least one intermediate insulating member comprising an insulating frame gasket cut out at a central portion to form at least one hollow electrolytic compartment between successive electrodes;

said plurality of planar electrodes including at least one intermediate electrode comprising a bipolar electrode having a pair of holes for passing electrolyte therethrough, one of said pair of holes being in an upper part of one side of said intermediate electrode and the other of said pair of holes being in a lower part on the same side of said intermediate electrode; said intermediate electrode having the same coating on its anode surface as that of the terminal anode;

the holes for passing electrolyte in said planar electrodes being disposed on opposite sides of successive electrodes to provide a sinuous flow path for the electrolyte through said at least one electrolytic compartment;

the ratio of the length to the width of the outer dimension of said planar electrodes and said planar insulating members being within the range of from 1:1.1 to 1:10;

said first end plate having a further hole for receiving a heat exchanging outlet water pipe;

said first insulating pipe plate having said heat exchanging water outlet pipe on the upper part on the same side or on the other side thereof;

said heat exchanging water outlet pipe passing through said further hole of said first end plate and disposed substantially perpendicularly to said first insulating pipe plate;

said terminal anode having another hole for passing heat exchanging water to the heat exchanging water outlet pipe;

said insulating frame gasket having a hole on a side thereof for passing heat exchanging water;

said bipolar electrode having a further hole in a central portion of the same side or the other side thereof for passing heat exchanging water;

said terminal cathode having a further hole in a central portion of said one side thereof for passing heat exchanging water;

said second insulating pipe plate having a further hole in a central portion of the other side thereof for receiving a heat exchanging water inlet pipe;

said second end plate having a further hole in a central portion of the other side thereof for receiving said heat exchanging water inlet pipe;

said heat exchanging water inlet pipe passing through said further hole of said second end plate;

a heat exchanging gasket inserted after every group of 3 to 7 of said electrolytic compartments, said heat exchanging gasket having a pair of holes for passing electrolyte, one of said pair of holes being in an upper part of a side of said heat exchanging gasket and the other of said pair of holes being in a lower part on the same side thereof;

an intermediate terminal anode and an intermediate terminal cathode being on opposed faces of said heat exchanging gasket, each of said intermediate terminal anode and said intermediate terminal cathode having a pair of holes for passing electrolyte, one of said pair of holes being in an upper part of said intermediate terminal anode and said intermediate terminal cathode on the same side and another of said pair of holes being in a lower part on the same side thereof, said intermediate terminal cathode having a further hole in a central portion on the same side or on the other side for passing heat exchanging water, said intermediate terminal anode having a further hole in a central portion on the same side or on the other side thereof for passing heat exchanging water, and said intermediate terminal anode and said intermediate terminal cathode having protruding upper edges serving as an electrical connection terminal on a side;

wherein the ratio of the length to the width in the outer dimension of said heat exchanging gasket, said intermediate terminal anode and said intermediate terminal cathode being within the range of from 1:1.1 to 1:10.

4. The filter-press type electrolytic cell of claim 3, wherein said insulating members and electroues define at least three hollow electrolytic compartments, and further comprising:

a planar degassing block inserted after every group of 3 to 7 of said electrolytic compartments; said planar degassing block comprising a pair of holes, one of said pair of holes being in an upper part of a side of said planar degassing block for passing gas and another of said pair of holes being in a lower part of the same side of said planar degassing block for passing electrolyte; a further hole in a central portion of the same side or the other side of said planar degassing block for passing heat exchanging water; and a degassing pipe communicating with said gas passing hole for passing gas; wherein the ratio of the length to the width of the outer dimension of said degassing block is within the range of from 1:1.1 to 1:10.

5. The filter-press type electrolytic cell of claim 4 wherein said heat exchanging gasket and said planar degassing block are positioned between the terminal cathode and the second insulating pipe plate.

6. The filter-press type electrolytic cell of claim 3 wherein said heat exchanging gasket is positioned between the terminal cathode and the second insulating pipe plate.

* * * * *

UNITED STATES PATENT AND TRADEMARK OFFICE

CERTIFICATE OF CORRECTION

PATENT NO. : 4,495,048

DATED : January 22, 1985

INVENTOR(S) : Katsuyuki MURAKAMI et al

It is certified that error appears in the above-identified patent and that said Letters Patent is hereby corrected as shown below:

Column 11, line 56, "4%" should read --34%--;

Column 13, line 59, "from 42%" should read --from 42 to 94%--.

Signed and Sealed this

*Seventeenth* Day of *September 1985*

[SEAL]

*Attest:*

*Attesting Officer*

DONALD J. QUIGG

*Commissioner of Patents and Trademarks—Designate*